US005852866A

United States Patent [19]

Kuettner et al.

[11] Patent Number: 5,852,866

[45] Date of Patent: Dec. 29, 1998

[54] PROCESS FOR PRODUCING MICROCOILS AND MICROTRANSFORMERS

[75] Inventors: Klaus Kuettner, Stuttgart; Dietmar Hahn, Gerlingen; Gottfried Flik, Leonberg; Markus Ohnmacht, Stuttgart, all of Germany

[73] Assignee: Robert Bosch GmbH, Stuttgart, Germany

[21] Appl. No.: 832,426

[22] Filed: Apr. 2, 1997

[30] Foreign Application Priority Data

Apr. 4, 1996 [DE] Germany ..... 196 13 495.1
Oct. 2, 1996 [DE] Germany ..... 196 40 676.5

[51] Int. Cl.[6] ..... H01F 41/02

[52] U.S. Cl. ..... 29/608; 29/602.1; 29/830; 29/848; 336/200

[58] Field of Search ..... 29/602.1, 608, 29/848, 849, 830; 336/200, 233

[56] References Cited

U.S. PATENT DOCUMENTS 5,349,743 9/1994 Grader et al. ..... 29/602.1
5,398,400 3/1995 Breen ..... 29/602.1

FOREIGN PATENT DOCUMENTS 551 735 7/1993 European Pat. Off. .

*Primary Examiner*—Carl E. Hall
*Attorney, Agent, or Firm*—Kenyon & Kenyon

[57] ABSTRACT

A process for producing single-layer or multi-layer microcoils or microcoil arrays that optionally have a magnetic core area to increase the coil inductance and to guide the magnetic flux. In this process, plastic films (e.g., made of polyimide or polyester), are applied using pressure and heat to serve as the insulation layers. This eliminates the need for curing the insulation and expensive leveling operations.

15 Claims, 4 Drawing Sheets

PROCESS FOR PRODUCING MICROCOILS AND MICROTRANSFORMERS

FIELD OF THE INVENTION

The present invention relates to a process for producing microcoils and microtransformers.

BACKGROUND INFORMATION

A process is already known, for example in European Pat. No. 551,735 A1 where coil windings and insulation layers are applied in alternation starting on one side of a substrate. The known process uses insulation layers which, like photostructurable polyimide, for example, require time-consuming curing and leveling processes, because flat surfaces are needed for photolithographic structuring or for electroplating.

SUMMARY OF THE INVENTION

Compared to the related art, the process according to the present invention has the advantage that the insulation layers are produced by press application of plastic films with simultaneous leveling of the surface. This eliminates curing of the insulation and complicated leveling operations in addition to yielding good structural resolution in photographic processes and homogeneous layer thicknesses for galvanic processes.

Another advantage is the fact that a greater optical resolution can be achieved due to the use of positive lacquers as the photostructurable layers in comparison with the use of photostructurable polyimides (approximately 4 micrometers with positive lacquer in comparison with approximately 10 micrometers with polyimides). With positive lacquers, a height to width ratio of the structures (aspect ratio) of up to 10 can be achieved in microstructures, so a definite lateral miniaturization of the coils can be achieved with the same cross-sectional area of the coil windings and thus with the same electric resistance. With polyimides, however, an aspect ratio of only up to approximately 4 can be achieved. Furthermore, using plastic films and positive lacquers avoids the need for curing the polyimide molds that would otherwise be used, where the material shrinkage may amount to several tens of percent and causes a loss of structure and rounding of the edges. When polyimide is used as the photoresist, it is used in its precursor form which does not develop chemical resistance, long-term stability or electric insulation ability until it has been cured for several hours at 300° to 400° C.

Furthermore, it is also advantageous according to the present invention to integrate stacked coil windings that are electrically connected by through-plating through the insulation. This through-plating may be inside the coil winding. This permits practically any design for microcoils with comparatively high inductance values. Since lateral connections of coils arranged side by side are also possible, complex coil arrangements such as arrays or transformers are also possible.

It is especially advantageous if the plastic films are provided with a metal layer on the side facing away from the surface to be leveled. Moreover, in addition to eliminating a separate leveling step, this also eliminates the application of a conducting primer layer for a galvanic or currentless metal deposition process or by applying an etching mask.

Integration of magnetic core materials or use of magnetic insulation materials increases coil inductance in an advantageous manner and establishes well-defined paths for the magnetic flux (e.g., for the return of the flux to a coil center). This permits functional arrangements for sensors and actuators.

Iron-nickel alloys with their relatively high magnetic permeability are advantageously suitable for the magnetic areas that serve as soft magnetic flux conductors, for example.

Integration of hard magnetic materials, such as ternary or quaternary alloys, as magnetic flux sources offers technical advantages in using the coil, for example, in magnetic coupling of coils, in bistable relays or inductive sensors.

Using a hard magnetic powder dispersed in a photostructurable polymer as the hard magnetic material for the core area is an inexpensive alternative to a galvanic process.

Depending on the intended use of the microcoils, it may be advantageous to integrate the manufacturing process with existing technologies (as an additive technology, for example, coupled with micromechanical processes and/or IC manufacturing following micromechanical processing or following IC production). Copper, silver, or gold can be used in an advantageous manner as a coil winding material.

The inexpensive manufacturing process according to the present invention can be advantageously used, for example, in the production of mass products such as displacement sensors in nozzle arrangements (e.g., for fuel injection systems in motor vehicles).

BRIEF DESCRIPTION OF THE DRAWINGS

Exemplary embodiments of the present invention are illustrated in the drawings and explained in greater detail hereafter.

DETAILED DESCRIPTION OF THE INVENTION

Figure 1:
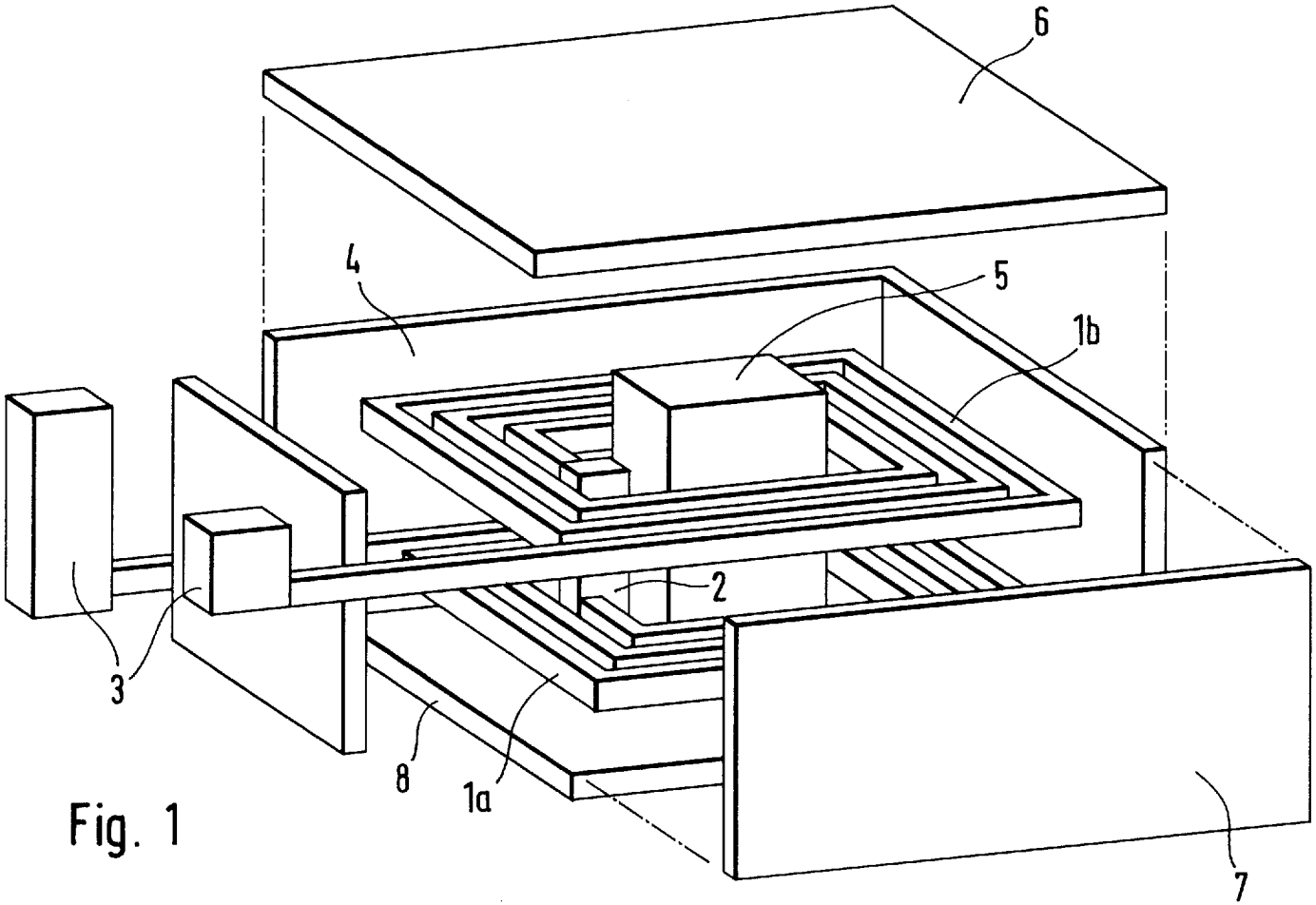
FIG. 1 depicts an example of the design of a two-layer microcoil with an enclosed soft magnetic core area according to the present invention.

FIG. 1 shows an exploded diagram of an example of a two-layer microcoil design with an enclosed soft magnetic core area including a magnetic core 5, magnetic core top part 6 and surrounding magnetic core area 7. This soft magnetic core area is one possible embodiment of a closed magnetic flux return. Stacked coil windings 1*a*, 1*b* enclose magnetic core 5. Coil windings 1*a*, 1*b* are in turn enclosed by surrounding core area 7 and by magnetic core bottom part 8 and magnetic core top part 6. Through-plating 2 in the core interior connects coil winding 1*a* to coil winding 1*b*. Contacts 3 are provided at the ends of coil windings 1*a*, 1*b* that lead outward across gaps in the surrounding magnetic core area 7. The space between the coil windings and between the coil windings and the magnetic core surrounding them, the magnetic core top part, the magnetic core bottom part and the surrounding magnetic core area is filled with an insulator 4. The type of coil described here serves to illustrate a typical design with a coil area of, for example, approximately 4 $mm^2$. Also possible are designs having more than two windings or where the design (geometries) of the windings and the core area are different. The number of turns per coil winding can be selected freely and may be between 5 and 100 turns per coil, for example. Integration of magnetic insulation materials is also possible. Insulator 4 may be made of, for example, polyimide, BCB, polyester or a similar material. The core area can also be made of ternary or quaternary hard magnetic alloys (including three or four elements from the following list, for example: Fe, Co, Ni, Mn, P). Galvanic integration of hard magnets as a permanent source of magnetic flux permits broader coil applications, including actuator applications (switches, relays), rapid compensation of a hard magnetic field by means of a coil current, etc.

The process according to the present invention is a general production process for single- or multi-layer spiral microcoils and for connections of coils. Microcoil arrays having suitably electrically connected and/or magnetically coupled microcoils can also be produced by the process according to the present invention (e.g., microcoil arrays with double-coil windings that can be used as microtransformers). The magnetic core areas serve to increase the coil inductance and to conduct the magnetic flux. Thick coil wires (for example, up to approximately $100\times100\ \mu m^2$ of cross-sectional area of the coil wire) can be produced to achieve a low resistance, and designs with a high aspect ratio (e.g., 100 $\mu$high and 10 $\mu$wide).

FIG. 2 depicts an example of a sequence of process steps in the process according to the present invention to produce a two-layer microcoil as described for FIG. 1. The process starts with a nonconducting substrate 20 (FIG. 2*a*) to which a conducting primer layer is applied first after a cleaning operation. Suitable substrate materials include, for example, glass, ceramics, silicon with a layer of silicon dioxide, compound semiconductors or plastics. The requirements of the substrate include good planarity and compatibility of the material with photolithographic and industrial galvanic process steps. To apply the primer layer, it is possible to apply metal layers or layer systems by sputtering or to apply metal-coated plastic films by lamination as in circuit board technology. In addition, currentless metal plating processes can also be used for coating the substrate.

After pretreatment of the substrate, a photoresist (liquid or solid resist) is applied as the structurable layer to the substrate. For example, liquid resists are applied by spin casting and solid resists are laminated. The thickness of a liquid resist layer is determined by the rotational speed, and the thickness of a solid resist layer is determined by the number of resist layers applied by lamination. In contrast with the solid resist, drying (prebaking) is required after a liquid resist is applied by spin casting. Depending on the potential resolution of the resist material and the required dimensions of the microcoil, typically resist layer thicknesses between 10 and 50 $\mu$are selected. In the next step the reverse structure of the magnetic core bottom part 8 is transferred to the resist by UV exposure with the help of a photolithographic mask and subsequent developing. This is followed by metal plating of the resist grooves with a magnetic material such as nickel iron.

After metal plating, the resist mold is removed, thus exposing the elevated metal structures on the surface. To apply insulation layer 4*a* in the next step and level the surface, an insulating plastic film such as polyimide, also available under the brand name Kapton®, or polyester, etc. is applied by lamination to fill the free areas between the webs of metal. This has the advantage that the complicated multistep spin casting and tempering process, which is required for liquid materials, is replaced by one simple step. The film used is a two-layer system. The adhesive epoxy layer applied to the side facing the substrate is free-flowing and is distributed in the metal interspaces when pressed onto the substrate. After pressing at an elevated temperature (e.g., in a range between 100° C. and 250° C.), the material is cured to provide it with long-term stability. A polyimide film, for example, which has chemical resistance and electric insulation properties, is applied over the adhesive film.

Then a conducting primer layer is again applied to insulation layer 4*a*. There are various possibilities for implementing this step:

a) Sputtering a metal layer or system:

In this process, metal atoms emitted from a metal target by accelerated ions in a plasma are deposited on the insulation layer.

b) Using metal-coated films:

It is especially advantageous if an already metalcoated film is used in the preceding step of applying an insulation layer 4*a*. This eliminates the need for separate application of a conducting primer layer, so it greatly simplifies the process sequence and results in lower costs.

c) Currentless metal coating:

The process sequence is also simplified if a seed layer is applied to insulation layer 4*a* for currentless metal deposition. This can be accomplished, for example, with a complex palladium compound by a wet chemical process or by sputtering a layer of platinum or palladium a few atoms thick. The seed layer serves as the basis for currentless deposition of a metal layer on the insulation. However, currentless deposition is not performed until the next step, after structuring the resist mold for the first coil layer. This has the advantage that after the first bottom coil winding has been created galvanically, it is not necessary to remove the primer layer by an etching process to remove the conducting areas between the coil windings.

After applying a conducting primer layer or a seed layer, a photoresist that is photolithographically structured is applied to produce a first coil winding.

In contrast with methods a) and b), a thin layer of metal is first deposited by a chemical process inside the resist grooves in the above-mentioned currentless metal coating process. Since the conductivity of the seed layer (see above) is very low, no conducting connections to the areas below the resist are formed. After this step, only the areas where a metal is later to be deposited galvanically are electrically conducting and after this step, the individual structures must be connected by metal paths having a good conductivity, which requires a special mask layout. The electric connecting webs are severed mechanically only after completion of the coil.

After photostructuring of the resist mold and for case c) of selective metal coating, the resist grooves are filled with copper (e.g., in a galvanic process). Finally, the photoresist is removed again. In cases a) and b) the primer layer is then removed by an etching process. This is not necessary in case c), because only individual areas are metal-coated selectively. Then a second insulation layer 4*b,* a polyimide film such as a Kapton film according to the present invention, is applied using pressure and heat to ensure insulation from the next coil layer (see FIG. 2*b*).

For connecting (through-plating) the first coil winding 1*a* to a second coil winding 1*b* to be produced subsequently (cf. FIG. 2*c*), first a mask material such as a photoresist layer, an oxide layer or a metal layer is applied and structured by photolithographic and etching steps (only with the oxide and metal masks). In addition to sputtered layers, the metal layer can also be applied here in lamination of the insulation layer in the preceding process step by using a premetallized film. In each case, however, it is necessary to structure the metal layers by a photolithographic step and an etching step. With the help of the etching mask produced in this way, the insulation layer is etched down to the bottom coil layer using a dry etching process. As an alternative to the dry etching process, a laser beam (e.g., laser ablation with an Excimer laser) can also be used to remove the insulation layer down to the bottom coil layer at one point; this laser structuring does not require masking of the insulation layers.

After the dry etching process, the mask (if any) is removed from the insulation layer and a sputtered metal layer is applied to the insulation and into the plated-through hole 2*a.*

The process used for the second coil winding 1*b* is similar to that used for the first coil winding 1*a,* to finally insulate the second coil winding 1*b* from the magnetic core top part 6 to be produced subsequently with a third insulation layer 4*c.*

This is followed first by production of the surrounding magnetic core area and the magnetic core itself, both of which together serve as a closed magnetic flux path when the coil is in use. As in the process step to produce the plated-through hole with the help of a mask, the grooves for recesses 5*c* and 7*c* for the magnetic core and the surrounding magnetic core area are etched down to the magnetic core bottom part with the help of a mask and then they are filled with a soft magnetic material (see FIGS. 2*d,* 2*e*). The mask is then removed as in the process step for producing the plated-through hole.

Figure 2A:
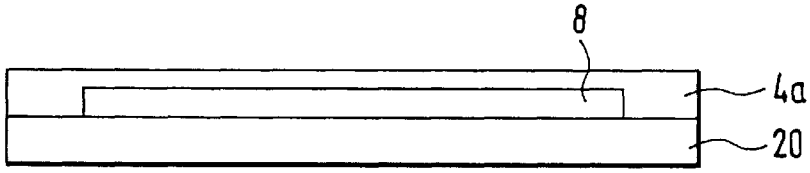
FIG. 2*a* depicts a first layer applied by the process according to the present invention.
Figure 2B:
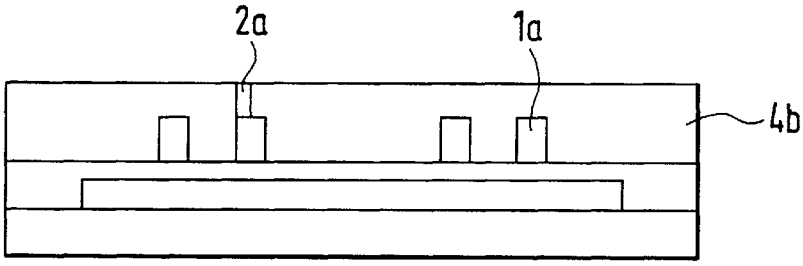
FIG. 2*b* depicts a second layer applied by the process according to the present invention.
Figure 2C:
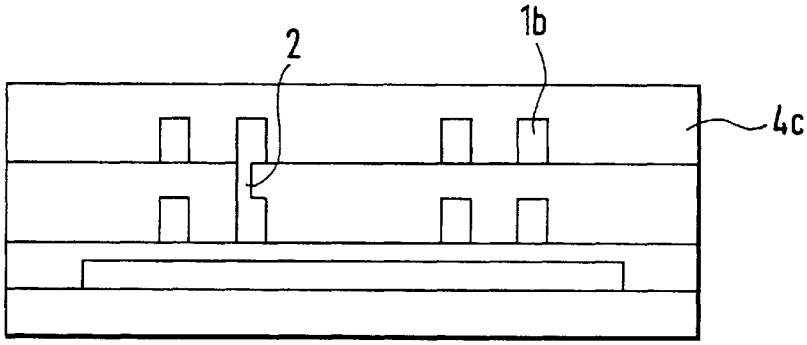
FIG. 2*c* depicts a third layer applied by the process according to the present invention.
Figure 2D:
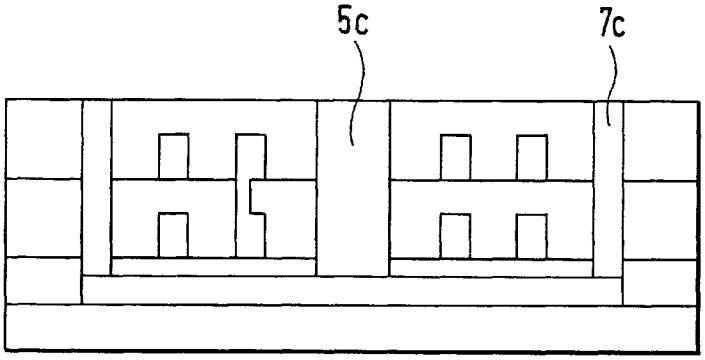
FIG. 2*d* depicts processing of the layers shown in FIG. 2*c* by the process according to the present invention.
Figure 2E:
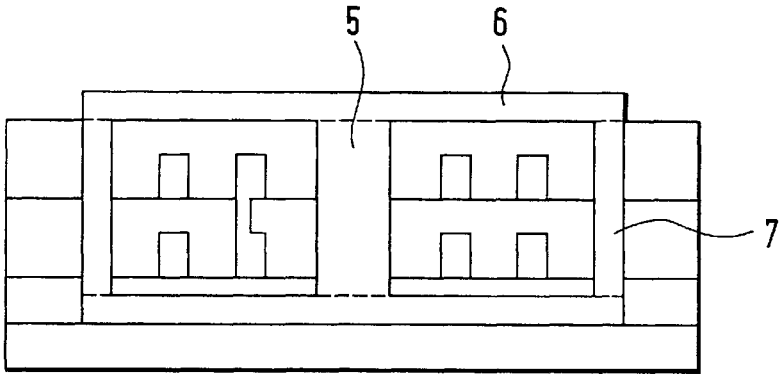
FIG. 2*e* depicts further processing of the layers shown in FIG. 2*d* by the process according to the present invention.

This is followed by production of the magnetic core top part 6 (FIG. 2*e*). The procedure followed here is the same as that used to produce the first coil winding, so first a conducting primer layer is applied, and then a photoresist is applied and structured. Then the resist grooves are filled up again with the soft magnetic core material and next the photoresist is removed and a plastic film is applied and pressed to encapsulate the coil.

After finishing the microcoils, the individual elements are separated mechanically (e.g., by sawing). This severs any electric connections between the components.

Figure 3:
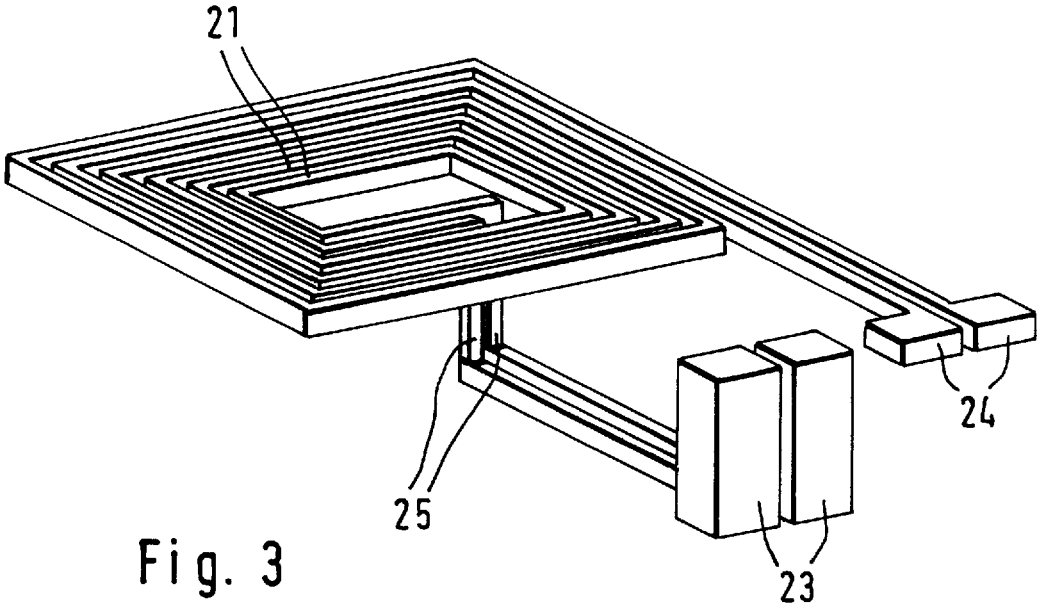
FIG. 3 depicts the wiring of a single-layer microcoil with double coil windings (microtransformer) according to the present invention.

FIG. 3 depicts the wiring of a single-layer microcoil produced by the process according to the present invention, with a double-coil winding 21 that can be used as a microtransformer. Double-coil winding 21 can be contacted at double contacts 23, 24, where a double plated-through hole 25 produces the electric connection between double-coil winding 21 and double contact 23.

Figure 4:
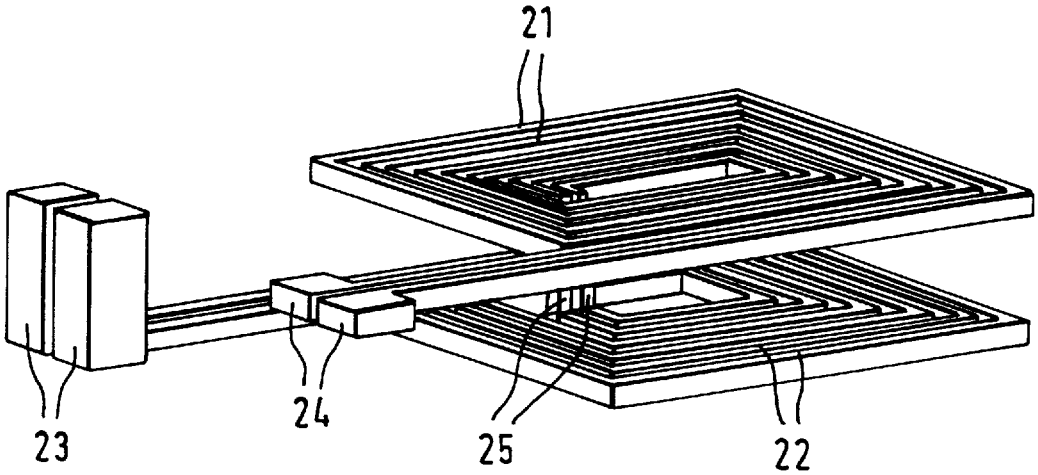
FIG. 4 depicts the wiring of a two-layer microtransformer according to the present invention.

FIG. 4 depicts the wiring of another embodiment of a microcoil with double-coil windings in a two-layer design manufactured by the process according to the present invention. The first and second double-coil windings 21 and 22 are electrically connected by double plated-through hole 25.

Figure 5:
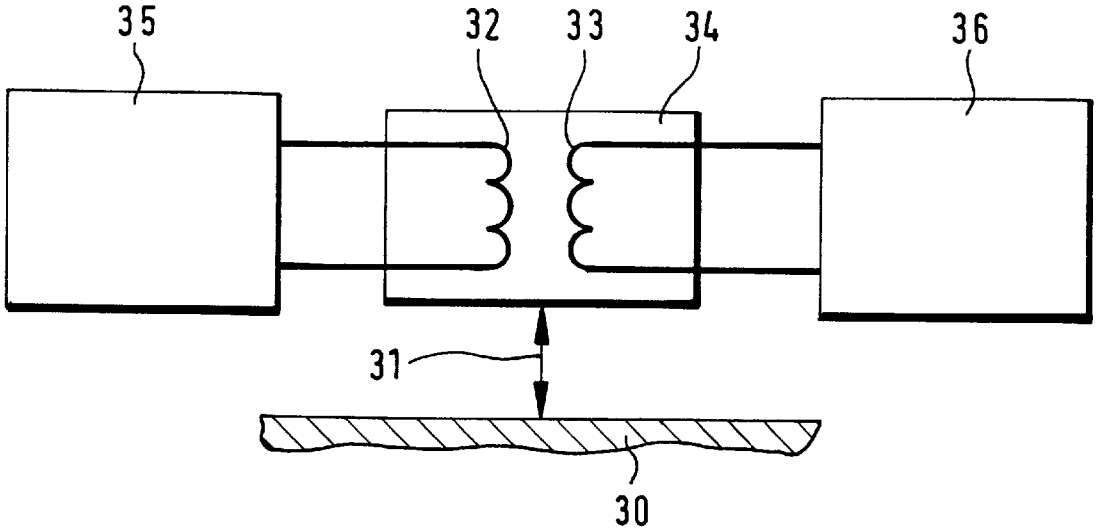
FIG. 5 depicts a miniaturized displacement sensor for measuring the distance/path of small metal objects according to the present invention.

The embodiments illustrated in FIGS. 3 and 4 are suitable for use as a sensor element 34 (FIG. 5) in a miniaturized displacement sensor for measuring small paths of metal objects 30. An a.c. signal is fed into primary coil 32 of the microtransformer from an a.c. signal source 35, and a phase analyzer 36 is connected to secondary coil 33. Distance 31 between the metal object 30 and sensor element 34 can be determined with phase analyzer 36. In this example the coils of the microtransformer are connected with a transmission coefficient of 1. A metal object 30 near the sensor element 34 alters the transmission coefficient between the individual coils and thus alters the phase angle of the secondary signal. When there is no metal object, there is a phase difference of 90° between the a.c. signal and the phase angle of the signal in the secondary coil 33. As the metal object approaches the sensor element, the phase difference changes, so this change can be used to measure the distance. In comparison with simply measuring the change in coil inductance (e.g., on the basis of the shift in resonant frequency in a resonant circuit), measuring the phase offers the advantage that the sensor element can be miniaturized without having to increase the excitation frequency of the a.c. signal source into the 100 MHZ range at the same resolution. Depending on the measurement requirements, the excitation frequency of the sensor element described here is in the range from a few times 10 kHz up to a few MHZ. This comparatively low frequency offers the advantage that the sensor element need not necessarily be integrated with the respective electronic analysis equipment.

The applications of a sensor element having the features described above cover a wide range because determining the position of a metal object is a general problem today in a number of applications. Thus, in production lines, the parts to be processed are often conveyed on a conveyor belt and the position of the workpiece or a conveyor carriage must be detected accurately. The workpieces must often be suitably aligned for processing, so position sensors are used. Other areas for using such sensors include any cases where the movement of an object is to be deduced from the change in position. An example would be fuel injection in an automotive vehicle, where a sensor element is supposed to detect the start of injection of the fuel from the stroke of a nozzle needle during the injection process. Therefore, the sensor element must be small to be suitable for integration into the nozzle holder.

What is claimed is:

1. A method for producing microcoils having at least one coil winding, comprising the steps of:

(a) applying a conducting primer layer to one side of an insulating substrate;

(b) applying a structurable layer to the conducting primer layer;

(c) structuring the structurable layer to form a mold for a coil winding;

(d) filling the mold with a material for the coil winding;

(e) removing the structurable layer; and (f) applying, via a leveling process, an insulating layer of plastic film having an adhesive layer over the coil winding.

2. The method according to claim 1, wherein the plastic film includes one of polyimide and polyester.

3.. The method according to claim 1, wherein the insulating layer of plastic film is applied by pressure and heat.

4. The method according to claim 1, wherein the coil winding is designed as a double coil winding.

5. The method according to claim 1, wherein the structurable layer includes a positive lacquer.

6. The method according to claim 1, wherein a material for the coil winding includes one of Cu, Ag and Au.

7. The method according to claim 1, further comprising the step of:

(g) repeating steps (a) through (f) for each additional coil winding, so that the coil windings have a stacked configuration.

8. The method according to claim 7, further comprising the step of, after applying the insulating layer of plastic film:

introducing a plated-through hole in the layer of plastic film by forming a contacting hole in the insulating layer, the plated-through hole extending to the coil winding underneath and being filled with the material for the coil winding.

9. The method according to claim 1, wherein the layer of plastic film is provided with a metal layer, the metal layer functioning as one of a conducting primer layer and an etching mask on a side of the coil winding facing away from a surface to be leveled.

10. A method for producing microcoils having at least one coil winding, comprising the steps of:

(a) producing a magnetic core bottom part on one side of an insulating substrate;

(b) covering the magnetic core bottom part with an insulation layer;

(c) applying a conducting primer layer on the insulation layer;

(d) applying a structurable layer to the conducting primer layer;

(e) structuring the structurable layer to form a mold for a coil winding;

(f) filling the mold with a material for the coil winding;

(g) removing the structurable layer;

(h) applying, via a leveling process, an insulating layer of plastic film having an adhesive layer over the coil winding;

(i) repeating steps (c) through (g) for each additional coil winding, so that the coil windings have a stacked configuration;

(j) forming a first recess in a core area surrounded by the coil windings and forming a second recess in a surrounding magnetic core area surrounding the coil windings, the first and second recesses extending through the insulating layer of plastic film of each coil winding and through the insulation layer of the magnetic core bottom part;

(k) filling the first and second recesses with a magnetic material; and (l) forming a magnetic core top part connecting the core area and the surrounding magnetic core area, wherein the core area and the surrounding magnetic core area are connected to the magnetic core bottom part.

11. The method according to claim 10, wherein the magnetic material includes FeNi.

12. The method according to claim 10, wherein the magnetic material includes one of a ternary alloy and a quaternary alloy.

13. The method according to claim 10, wherein the magnetic material includes a hard magnetic powder dispersed in a polymer.

14. The method according to claim 10, wherein at least one of the first and second recesses is filled with a predetermined magnetic insulation material to create specific flux paths.

15. The method according to claim 10, wherein the coil windings are made of one of Cu, Ag and Au.

* * * * *

UNITED STATES PATENT AND TRADEMARK OFFICE

CERTIFICATE OF CORRECTION

PATENT No. : 5,852,866

DATED : December 29, 1998

INVENTOR(S): Klaus Kuettner; Dietmar Hahn; Gottfried Flik; Markus Ohnmacht

It is certified that error appears in the above-identified patent and that said Letters Patent is hereby corrected as shown below:

Column 3, line 37, "$\mu$high" should be --$\mu$m high--;

Column 3, line 37, "$\mu$wide" should be --$\mu$m wide--; and

Column 3, line 64 "50 $\mu$are" should be -- 50 $\mu$m are--.

Signed and Sealed this

Fourteenth Day of September, 1999

*Attest:*

Q. TODD DICKINSON

*Attesting Officer*

*Acting Commissioner of Patents and Trademarks*